US008011944B2

(12) United States Patent
Umehara et al.

(10) Patent No.: US 8,011,944 B2
(45) Date of Patent: Sep. 6, 2011

(54) ELECTRICAL CONNECTOR ASSEMBLY

(75) Inventors: Hirokazu Umehara, Tokyo (JP); Takeshi Kumazawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 0 days.

(21) Appl. No.: 12/760,011

(22) Filed: Apr. 14, 2010

(65) Prior Publication Data

US 2010/0267269 A1 Oct. 21, 2010

(30) Foreign Application Priority Data

Apr. 16, 2009 (JP) ..... 2009-099978
Jan. 21, 2010 (JP) ..... 2010-011225

(51) Int. Cl.
*H01R 4/50* (2006.01)

(52) U.S. Cl. ..... 439/345

(58) Field of Classification Search ..... 439/399, 439/404, 345, 409
See application file for complete search history.

(56) References Cited

U.S. PATENT DOCUMENTS

| | | | | |
|---|---|---|---|---|
| 4,062,616 | A | 12/1977 | Shaffer et al. | |
| 4,426,125 | A * | 1/1984 | Crawford | 439/404 |
| 7,021,958 | B2 * | 4/2006 | Shindo et al. | 439/409 |

FOREIGN PATENT DOCUMENTS

| | | |
|---|---|---|
| EP | 0606739 | 7/1994 |
| EP | 1526607 | 4/2005 |
| JP | 01-044580 | 3/1989 |
| JP | 2002-033150 | 1/2002 |
| WO | 2005/057729 | 6/2005 |

OTHER PUBLICATIONS

EP Search Report, Aug. 5, 2010.
Office Action for Japanese Patent Application 2010-011225, Japan Patent Office, Apr. 26, 2011.

* cited by examiner

*Primary Examiner* — Edwin A. Leon
(74) *Attorney, Agent, or Firm* — Kubotera & Associates, LLC

(57) ABSTRACT

An electrical connector assembly includes a cable connector; a receptacle connector connected to the cable connector in a first direction; and a locking protruding portion disposed on one of the cable connector and the receptacle connector. The locking protruding portion has a first length in a second direction perpendicular to the first direction. The electrical connector assembly further includes a locking groove portion disposed in the other of the cable connector and the receptacle connector. The locking groove portion has a second distance in the second direction smaller than the first length, so that the locking protruding portion can be inserted into the locking groove portion only in an inclined state and the receptacle connector is not disconnected upwardly from the cable connector when the locking protruding portion is situated in the locking groove portion.

12 Claims, 8 Drawing Sheets

ELECTRICAL CONNECTOR ASSEMBLY

BACKGROUND OF THE INVENTION AND RELATED ART STATEMENT

The present invention relates to an electrical connector assembly having a cable connector and a receptacle connector, which are fitted to each other to connect on a fitting surface formed on a circumferential face of a housing.

As such an electrical connector assembly, for example, a connector disclosed in Patent Reference has been known. The electrical connector assembly of Patent Reference has a fitting surface, which is formed by side wall surfaces and an end wall surface that is perpendicular to the side walls, and has a rear end wall surface for a cable's extending side of a cable connector.

In Patent reference, a receptacle connector has a fitting protrusion on a side wall surface, which faces inward, so as to form a locking unit to prevent a connector from coming off by having the fitting protrusion locked in a fitting recess of the cable connector upon fitting of a cable connector thereto. The locking unit is provided on the side wall surface at a position on the rear portion that is to be on the extending side of a cable. Further, a cam surface made of a slanted surface is provided at the front part on a side wall face of the both connectors.

When the cable is pulled backward after fitting of the connectors, the force will generate a force component that is directed upward on the cam surfaces of the both connectors, i.e. a force component in a direction of pulling out the connector. With the force, it is possible to easily pull out the connector against the locking force by the locking unit.

Patent Reference: Japanese Patent Publication No. 2002-033150

In case of the connector of Patent Reference, needless to say, not only when force to pull the cable of the cable connector backward is intentionally applied, but also when such force is unexpectedly applied, the locking unit becomes released and thereby the connector may become come off, i.e. unexpectedly come off.

In case of a cable connector, the cable may often unexpectedly receive undue force having a component in the pulling-out direction. In a case of the connector of Patent reference, if the cable unexpectedly receives such undue force, even if such force is the one in a simple cable-extending direction, it generates a force component in the upward direction due to the function of the cam surfaces and thereby the connector comes off. In addition, if the undue force on the cable originally has a component in the upward direction, the cable's coming off tendency is more significant.

In view of the above-described problems, an object of the invention is to provide an electrical connector assembly, in which a connector of a cable connector does not come off even if the cable unexpectedly receives undue force and even if such undue force includes a component in an upward direction, unless the cable connector is being intentionally pulled out.

Further objects and advantages of the invention will be apparent from the following description of the invention.

SUMMARY OF THE INVENTION

In order to attain the objects described above, according to the present invention, an electrical connector assembly includes a cable connector and a receptacle connector, which are fitted to each other to connect on a fitting surface formed on a circumferential surface of a housing, and the fitting surface is formed of side wall surfaces and a end wall surface that is perpendicular to the side wall surfaces, and the end wall surface, where the cable connector is disposed, is provided at the cable-extending side.

According to the invention, in the electrical connector assembly, one of a cable connector and a receptacle connector has a locking protruding portion, which has a protrusion front end and a protrusion rear end on a side wall surface at a position close to the rear end wall surface in the front-back direction, and the other has a locking groove portion that has a grove front end and a groove rear end on a side wall surface at a position that corresponds to the locking protruding portion in the front-back direction. The locking groove portion has a groove inlet on the insertion side in the connector fitting direction, and has a protrusion, which protrudes inside of the groove, at the groove front edge or the groove rear edge.

According to the invention, the distance between the backmost position of the groove front edge of the locking groove portion and the forefront position of the groove rear edge in the front-back direction is set smaller than the distance between the forefront position of the protrusion front edge of the locking protruding portion and the backmost position of the protrusion rear edge in the front-back direction, upon completion of fitting the connector.

In addition, when the cable connector and the receptacle connector become close to each other by moving in the fitting direction while being in the state upon completion of their regular fitting, the locking protruding portion and the locking groove portion interfere with each other. Then, the front end of the cable connector is tilted upward and becomes closer so as to be away from the receptacle connector than the rear end, the locking protruding portion is allowed to go inside the groove. After the locking protruding portion moves to a position that is deep in the locking groove portion, if the upward tilting becomes released and thereby the cable connector comes to take the regular fitting completion attitude, the cable connector keeps its attitude and moves in a pull-out direction, which is opposite the fitting direction, or is about to move in the pull-out direction so as to lift the rear end side, the locking protruding portion abuts with a rising portion of the locking groove portion and thereby prevents the cable connector from coming off.

According to the electrical connector assembly of the invention having the aforementioned configuration, upon fitting the connectors, the front end, i.e. on the side opposite the extending side of the cable, is tilted upward and the locking protruding portion moves inside the locking groove portion of the receptacle connector. Thereafter, the front end of the cable connector falls and thereby becomes in a completion state of regular fitting.

After fitting this way, even if lifted in the pull-out direction while being in the fitting completion state or even if the cable is pulled backward so as to lift the rear end, which is the cable's extending side, the locking protruding portion abuts with the protrusion of the locking groove and thereby the cable connector is prevented from coming off. Since the cable often unexpectedly receives undue force, the rear end of the connector becomes directed upward.

Accordingly, the invention is extremely effective to prevent the connector from coming off by the undue force. In addition, upon intentionally pulling out the cable connector, if the front end of the cable connector is lifted after directing upward, it is easy to pull out in a way contrary to upon connector fitting. If the front end of the cable connector is directed upward upon connector fitting, it is directed opposite to that when undue force is applied thereon, and such direction occurs only upon intentionally pulling out.

In the invention, the locking protruding portion may be provided on the cable connector and the locking groove portion may be provided on the receptacle connector. Alternatively, the locking protruding portion may be provided on the receptacle connector and the locking groove portion may be formed on the cable connector.

According to the invention, in order to make it easy for the locking protruding portion of the cable connector to move in the locking groove portion of the receptacle connector while the front end of the cable connector is tilted upward, at least one of the protrusion front end and the protrusion rear end of the locking protruding portion is preferably formed being tilted on the rear end side towards the front end in the connector's fitting direction.

With the configuration, at least one of the front protrusion end and the rear protrusion end, which are tilted as described above, becomes closer in the fitting direction for the upward tilting angle of the front end of the cable connector, therefore the locking protruding portion can enter the groove inlet of the locking groove portion. At this time, if the protrusion front end and the protrusion rear end are parallel, both of them become close in the fitting direction, so that the locking protruding portion can even more easily enter the groove inlet.

In the invention, the locking protruding portion preferably has an inclined portion at adjacent portion facing the protrusion of the locking groove portion, at the regular fitting completion attitude of the connector. With the inclined portion, the locking protruding portion can take the regular fitting completion attitude at a position closer to the protrusion of the locking groove portion. Accordingly, upon fitting, the locking protruding portion can easily move to the state at the fitting completion state, and upon unexpected lifting, immediately abuts with the protrusion, and the coming off problem of the cable connector can be immediately solved.

According to the invention, the cable connector and the receptacle connector preferably have an engaging portion, and an engaged portion, which lock each other at the front end side upon regular fitting completion of the connector. With the configuration, although it may rarely occurs, even if the cable connector receives force that unexpectedly lifts the cable connector at the front end side thereof, the front end would not be directed upward and thereby the cable connector is prevented from coming off.

The receptacle connector in the invention preferably has a bottom wall portion, which has a cut portion opening backward in order to allow a rear part of the cable connector to enter upon tilting upward. If the cut portion is formed on the bottom wall portion of the receptacle as described above, the cable connector can easily have the front part thereof direct upward by entering the rear part thereof in the space of the cut portion.

As described above, in the present invention, one of the cable connector and the receptacle connector has a locking protruding portion on the side wall face and the other has a locking groove portion at a corresponding position on the side wall face. When the front end of the cable connector becomes closer than the rear end being tilted upward so as to be away from the receptacle connector, the locking protruding portion is allowed to enter the groove, and after the locking protruding portion enters deep in the locking groove portion, the upward tilting becomes released and the cable connector completes the regular fitting.

Thereafter, if the cable connector is moved in the direction opposite the pull-out direction or moved in the pull-out direction so as to lift the rear end while keeping the fitting completion attitude, the locking protruding portion abuts with the protrusion of the locking groove portion and thereby the cable connector will be prevented from coming off. Therefore, even if the cable, which extends from the rear end of the cable connector, is unduly pulled, and even if the pulling force includes upward component, the locking protruding portion abuts with the protrusion of the locking groove, and therefore the cable connector will not come off from the receptacle connector. In most cases, the unduly pulling force includes the aforementioned upward component, and it is possible to securely solve unexpected effects caused by such force.

BRIEF DESCRIPTION OF THE DRAWINGS

FIG. 2(C) shows the state of completion of the fitting;

FIG. 3(B) shows the state during the fitting and FIG. 3(C) shows the state of completion of the fitting;

FIG. 4(C) shows the state of completion of the fitting;

FIGS. 5(A) to 5(C) are sectional views of another embodiment of the invention, wherein FIG. 5(A) shows a state before the connector fitting, FIG. 5(B) shows a state during the fitting and FIG. 5(C) shows a state of completion of the fitting;

FIGS. 8(A) to 8(C) are sectional views of yet still another embodiment of the invention, wherein FIG. 8(A) shows a state before the connector fitting, FIG. 8(B) shows a state during the fitting and FIG. 8(C) shows a state of completion of the fitting.

DETAILED DESCRIPTIONS OF THE PREFERRED EMBODIMENTS

Hereunder, referring to the accompanying drawings, embodiments of the invention will be described.

Figure 1:
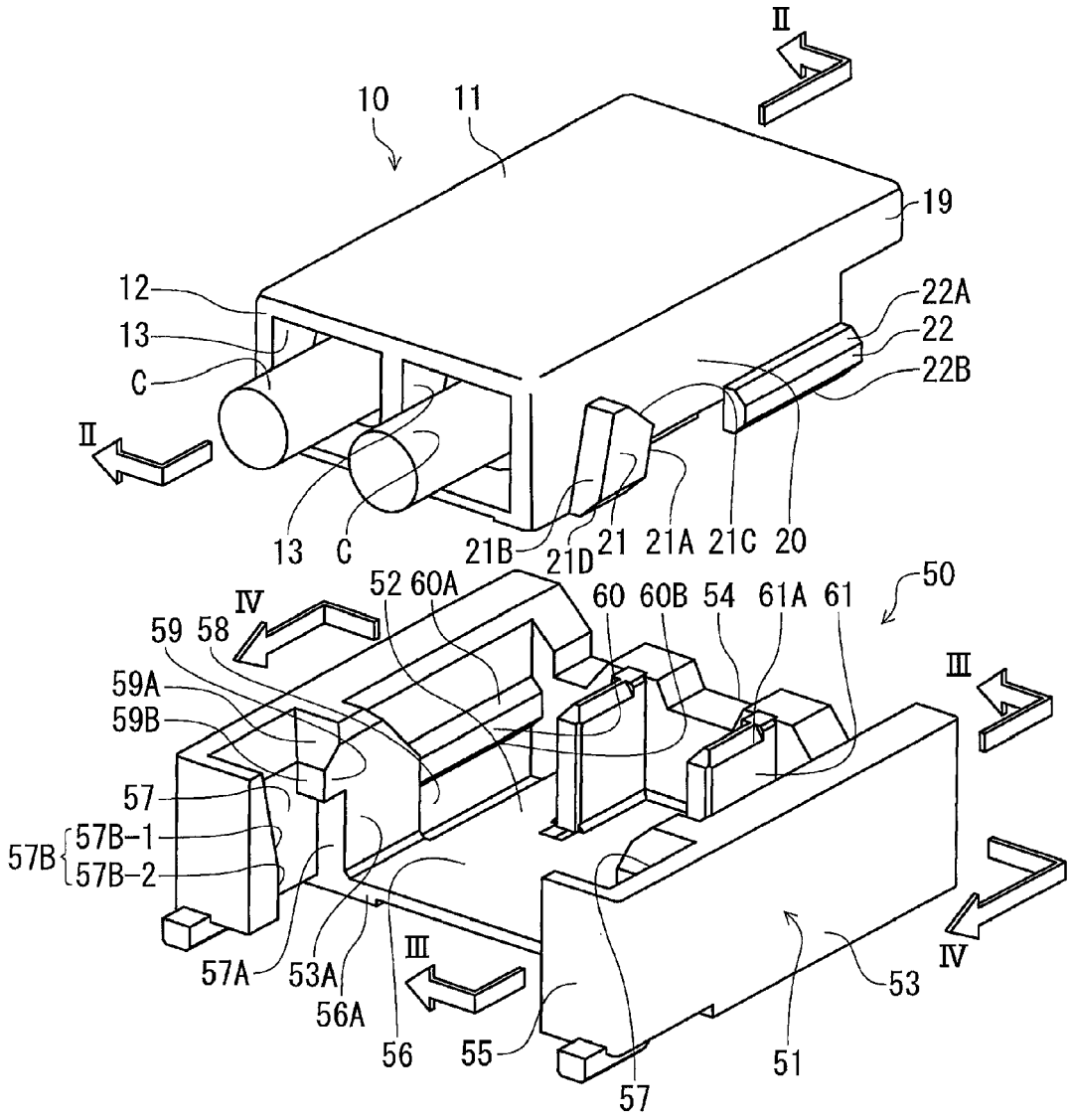
FIG. 1 is a perspective view of a cable connector and a receptacle connector before their fitting according to an embodiment of the invention.

In FIG. 1, reference numeral 10 is applied to a cable connector, and the cable connector 10 fit to a receptacle connector 50, which is a mating connector, and thereby electrically connected to each other.

The cable connector 10 has a housing 11 which has outer appearance of a generally rectangular solid and is made of an electrically insulating material, and holds a terminal connected to a cable C inside the housing 11. In the embodiment, two terminals are held in the housing 11, and the cables C that are connected to the respective terminals extend from two openings 13 formed on the end wall surface behind the housing 11.

Figure 2A:
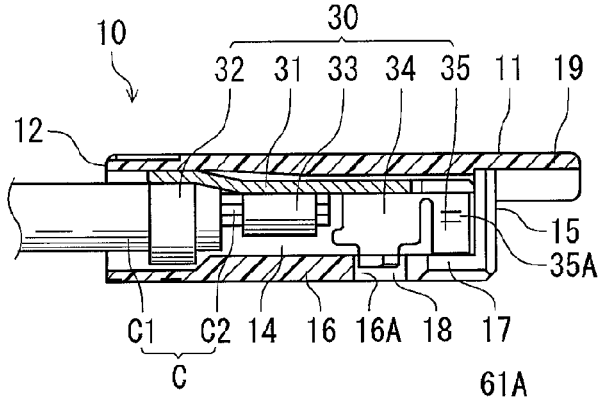
FIGS. 2(A) to 2(C) are sectional views showing the cable connector and the receptacle connector at a corresponding position, taken along a line II-II of FIG. 1, wherein FIG. 2 (A) showing a state before the connector fitting, FIG. 2 (B) showing a state during the fitting.

As shown in FIG. 2(A), in the embodiment, the terminal 30 is a crimp terminal. In the embodiment, however, the terminal is not limited to a crimp terminal, and may be also a terminal that is connected by another method such as pressure-welding or soldering. The terminal 30 is made by moldering and bending a sheet metal, and has a strip-like flat portion 34, and holding pieces 32 that are paired and extend from the both side edges of the flat portion 31, crimp piece 33, a locking piece 34, and a contact piece 35 in this order.

The cable C to be connected to the terminal 30 has its sheath C1 stripped at its front end, and exposes a core wire C2. The holding piece 32 of the terminal 30 is bent to tightly hold the outer sheath C1 of the cable C and holds the cable C. The crimp piece 34 is provided front (on the relatively right side shown in FIGS. 2(A) to 2(C)) than the core wire C2, and prevents the terminal with the cable from coming off by locking a corresponding locking edge of the housing, as described later, towards the backside. The pair of the contact pieces 35 has a throat-like portion 35A having a narrow portion at the middle position in the extending direction (downward in FIGS. 2(A) to 2(C)), and tightly presses a flat terminal of the receptacle connector 50, which enters from therebelow to between the pair of the contact pieces 35.

As shown in FIG. 2(A), the housing 11 has a terminal hole 14, which extends frontward from the opening 13 to insert the terminal 30, which is connected to the cable C, in the cable's longitudinal direction. The terminal hole 14 is provided through the frontal end wall surface 15 and opened, and also is opened downward at the bottom wall 16 at a front part of the housing 11, and thereby forms a terminal insertion slit 17 near the frontal end wall surface 15, and has a locking hole 18 therebehind.

The terminal insertion slit 17 has slightly larger width (the slit width in a rectangular direction on the paper surface in FIG. 2(A)) than the thickness of the flat terminal for inserting the flat terminal of the receptacle connector 50, which is the mating connector. In addition, the locking hole 18 adjacent to the terminal insertion slit 17 behind the terminal insertion slit 17 has a larger width in the rectangular direction on the paper surface than the terminal insertion slit 17, and the pair of locking pieces 34 of the terminal 30 can enter from thereabove.

The edge of the bottom wall 16 of the housing, which is a rear end of the locking hole 18 composes a locking edge 16A, and prevents the locking piece 34 from moving backward. The locking piece 34 moves forward to a position of the locking hole 18 by relative elastic displacement between the locking piece 34 and the bottom wall 16 upon insertion of the terminal 30 to the terminal hole 14, and thereby can be in a state of being able to lock with the locking edge 16A.

The housing 11 has a lifting piece 19 to pick and lift the front end, as being an extended portion of the upper wall at the front end.

The housing 11 has a fitting surface to fit to the receptacle connector 50, i.e. the mating connector, which has a circumferential wall made of the rear and front end wall surfaces 12 and 15 and the side wall surface 20. The side wall surface 20 has a locking protruding portion 21 at the rear portion and an engaging portion 22 at the front lower position respectively.

Figure 3A:
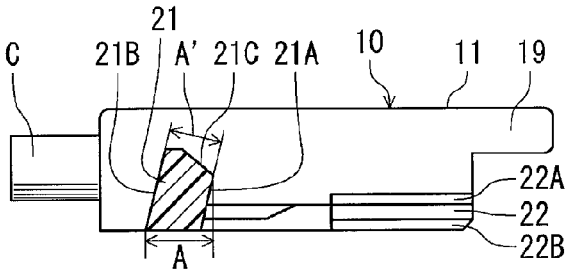
FIGS. 3(A) to 3(C) are sectional views showing the cable connector and the receptacle connector at a corresponding position, taken along a line III-III of FIG. 1, wherein FIG. 3 (A) shows the state before the connector fitting.

As shown in FIGS. 1 and 3(A), the locking protruding portion 21 has a protrusion front end 21A and a protrusion rear end 21B, and the both 21A and 21B are tilted in the connector fitting direction, i.e. downward in FIG. 1 towards the rear end side of the connector, and are parallel to each other in the embodiment. Above the protrusion front end 21A, an inclined portion 21C is formed. In addition, the lower end of the locking protruding portion 21 has a tapered portion 21D to make fitting to the mating connector easy (see FIG. 1).

On the other hand, the engaging portion 22 extends in a front-back direction while protruding downward from the lower edge of the housing 11. The engaging portion 22 has tapered portions 22A and 22B, which make easy locking and release of the locking with a engaged portion, which is a mating portion upon fitting to the mating connector and will be described later, at the upper edge and the lower edge. The engaging portions 22 are designed to be able to elastically displace in a rectangular direction relative to a surface of the side wall portion 20 of the housing 11.

The housing 51 of the receptacle connector 50 that accepts the cable connector 10 has a recessed portion 52 composed of a circumferential wall and a bottom wall as the receiving space (see FIG. 1). The circumferential wall of the housing 51 has a pair of parallel side walls 53, front edge wall 54, and a rear edge wall 55. Further, the bottom wall 56 connected to a lower part of the circumferential wall has a cut portion 56A, which is opened on a rear side, on the backside.

Each side wall 53 has a locking groove portion 57 at the rear position of the side wall surface 53A, which directs inward of the recessed portion 52, and an engaging groove portion 58 at a front position.

The locking groove portion 57 is provided through in the up-and-down direction between a groove front end 57A and a groove rear end 57B. An upper portion of the groove front end 57A has a rising portion 59 that protrudes backward. The rising portion 59 has a tapered portion 59A on the inlet side of the locking groove portion 57, i.e. upper edge portion. The rising portion 59 has an upright portion 59B, whose lower portion below the tapered portion 59A extends downward, and the shape of the upright portion 59B may not be strictly limited.

In the embodiment, it may be fine as long as the rising portion 59 has the tapered portion 59A. The groove front edge 57A forms an upright front end, having a lower portion of the rising portion 59 directed downward, and even the shape of the upright front end may be any as long as it has space to hold the aforementioned locking protruding portion 21 below the rising portion 59. The groove rear edge 57B of the locking groove portion 57 has a tilted guide portion 57B-1, which is tilted downward from the inlet of the locking groove portion 57, and an upright portion 57B-2 provided below the tilted guide portion 57B-1. The tilted guide portion 57B-1 extends to a position below the rising portion 59 in the up-and-down direction.

Next, the dimensional relation between the locking protruding portion 21 and the locking groove 57 in the front-back direction will be described.

In the locking protruding portion 21, when the cable connector 10 is in the attitude upon the fitting completion as shown in FIG. 3(A), i.e. in the attitude where any of the upper face and the lower face of the cable connector 10 and the cable extend in the horizontal direction and the front end is not lifted, a distance A or a length A between the forefront position of the protrusion front end 21A and the backmost position of the protrusion rear end 21B is the maximum as the width of the locking protruding portion 21 in the front-back direction.

On the other hand, the locking groove portion 57 of the receptacle connector 50 takes the minimum groove width in the front-back direction where the distance is a distance B in the front-back direction between the rear end position of the rising portion 59 and a position of the upright portion 57B-2. In the embodiment, the distance B is smaller than the distance A (B<A).

More specifically, even by simply descending the cable connector 10 from the attitude of FIG. 3(A), the locking protruding portion 21 cannot enter deep in the locking groove portion 57, and therefore it is impossible to fit the connectors. As also shown in FIG. 3(A), any of the protrusion front end 21A and the protrusion rear end 21B of the locking protruding portion 21 have their ends directed towards the front in the fitting direction, are tilted towards the rear end, and are parallel to each other.

Accordingly, if the attitude is set to be tilted upward for the amount of the tilting angle so as to be lifted towards the front end side, the relation with the distance A' between the protrusion front end 21A and the protrusion rear end 21B and the aforementioned distance B can be the distance A'<the distance B<the distance A.

Furthermore, in the embodiment, since the distance A' has relation with the distance B in the receptacle connector 50 as the distance A'<the distance B. Therefore, in the upward tilted attitude where the front end side of the cable connector 10 is lifted, the locking protruding portion 21 can enter deep in the locking groove portion 57. Moreover, since the locking groove 57 forms enough space for the portion below the rising portion 59 to house the locking protruding portion 21, the locking protruding portion 21 can return to the attitude where the cable connector 10 is in the horizontal state. In other words, the locking protruding portion 21 cannot come off by interfering with the rising portion 59 because of the relation (the distance B<the distance A), even if the cable connector is pulled out in the direction opposite the fitting direction.

Figure 4A:
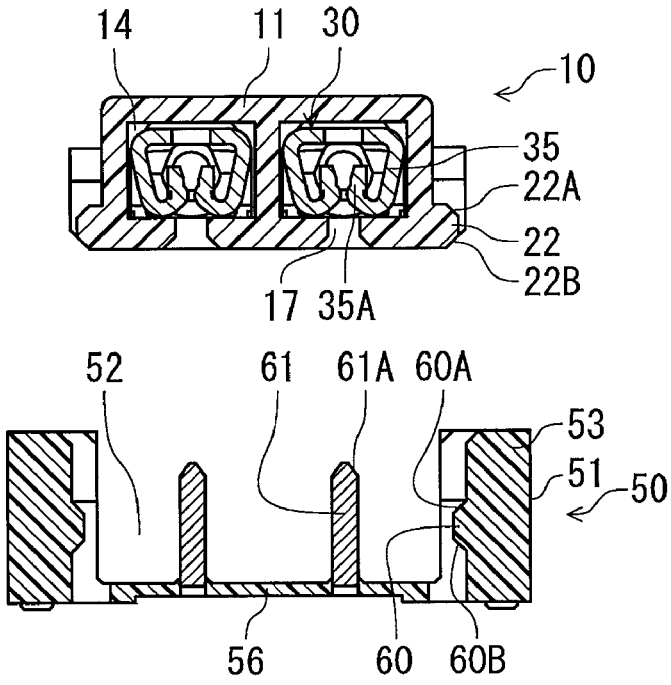
FIGS. 4(A) to 4(C) are sectional views of the cable connector and the receptacle connector at a corresponding position, taken along a line IV-IV of FIG. 1, wherein FIG. 4 (A) shows the state before the connector fitting, FIG. 4 (B) shows the state during the fitting
Figure 4B:
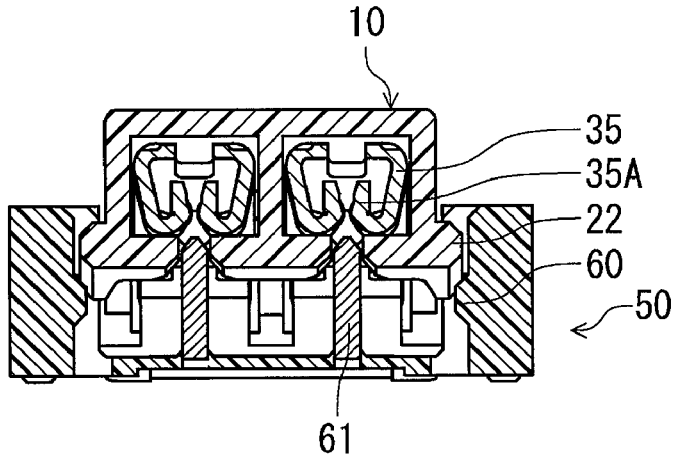
Figure 4C:
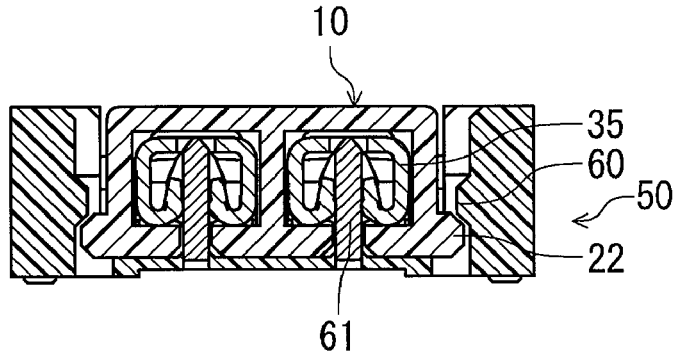

The receptacle connector 50 has the engaged portion 60 protruding strip-like portion that extends in the front-back direction in the engaging groove portion 58 formed in the front side position (also see FIGS. 4(A) to 4(C)). The engaging groove portion 58 has a groove width in the front-back direction to enable the engaging portion 22 of the cable 10 to enter therein. The engaged portion 60 also has a length that corresponds to the dimension of the engaging portion 22 in the front-back direction. Similarly to the engaging portion 22, the engaged portion 60 has a tapered portion 60A and a tapered portion 60B so as to make locking and release of the engaging portion 22 easy, as shown in FIGS. 4(A) to 4(C).

As shown in FIGS. 1 and 2(A), the receptacle connector 50 has two terminals 61 on an inner surface side of the front end wall 54. Each terminal 61 is made of sheet metal, which is flat expanding over a face including both the front-back direction and the fitting direction of the connector, and is bodily supported by the bottom wall 56 and the front end wall 54 of the housing 51 upon molding the housing 51, but can be also supported by being pressed in the housing 51. Each terminal 61 has a tapered portion 61A at the front end so as to easily insert the cable connector 10 between the pair of contact pieces 35 provided on the terminal 20 of the cable connector 35.

As described above, the bottom wall 56 of the receptacle connector 50 has the cut portion 56A so as to be opened on the rear side. In the embodiment, the cut portion 56A is formed behind than the groove front edge 57A of the locking groove 57 in the front-back direction, and is formed in the rage over the width in the direction of the cable connector 10. Therefore, the cable connector 10 can easily take the upward attitude having the front end side of the connector lifted in the fitting process, while having the rear part (a portion on the cable's extending side) of the cable connector 10 in the cut portion 56A.

Referring now to FIGS. 2(A) through 4(C), the points of fitting and connecting of the cable connector 10 and the receptacle connector 50 in the embodiment will be described below.

Figure 2B:
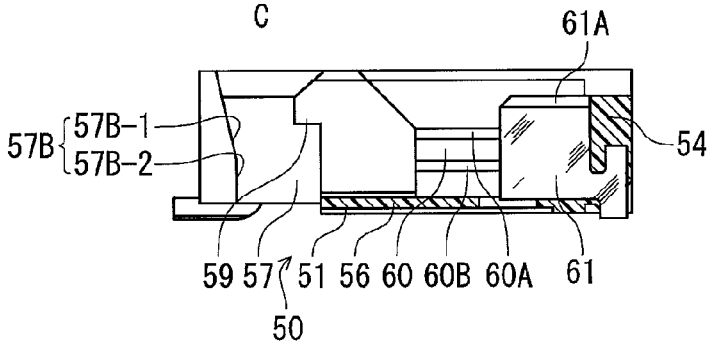
Figure 2B:
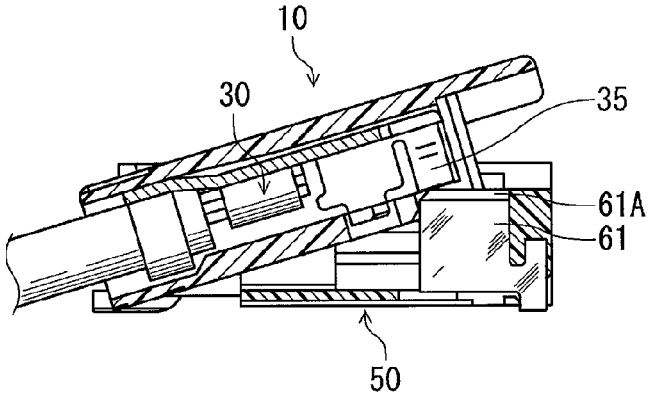
Figure 2C:
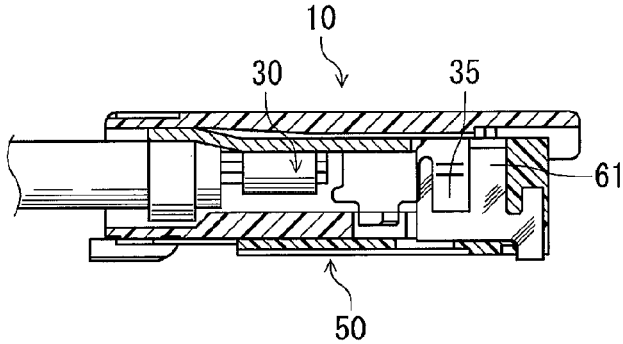
Figure 3B:
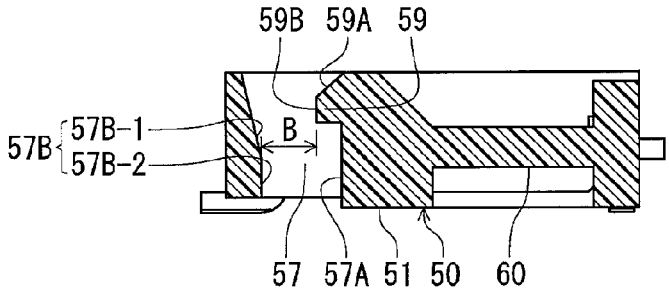
Figure 3B:
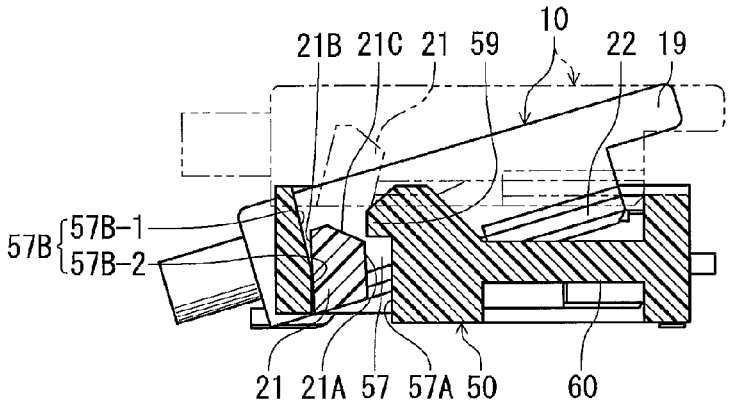
Figure 3C:
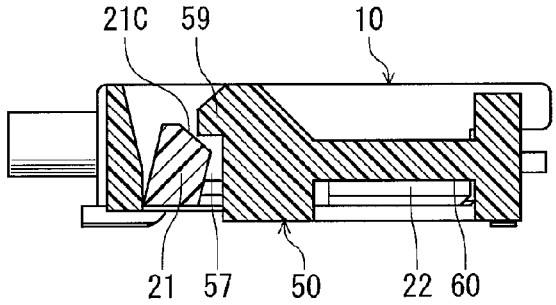

FIGS. 2(A) to 2(C) are sectional views of the cable connector 10 taken along line II-II, which is an axial position of the cable in FIG. 1 and a sectional view of the receptacle connector 50 at a position corresponding to the cable connector 10. FIGS. 3(A) to 3(C) are sectional views of the receptacle connector taken along the line III-III, which is a position within the range of the locking groove 57, and of the cable connector 10 at a position corresponding to the receptacle connector 50. Furthermore, FIGS. 4(A) to 4(C) are sectional views of the receptacle connector 10 taken along the line IV-IV that go through the both terminals 61 of the receptacle connector 50 and of the cable connector 10 at the corresponding position. FIGS. 2 (A), 3(A) and 4(A) show a state before connector fitting, FIGS. 2(B), 3(B) and 4(B) show a state in the middle of fitting, and FIGS. 2(C), 3(C) and 4(C) show a state at the time of completion of the fitting.

First, the cable connector 10, in which the cable C is connected to terminals 30, is moved to the position above the receptacle connector 50, i.e. the mating connector, while being in the attitude upon completion of regular fitting as shown in FIGS. 2(A), 3(A), and 4(A), i.e. in a state where the cable C horizontally extends backward while the cable connector 10 is being in the horizontal attitude.

Thereafter, descend the cable connector 10 while being in the attitude. The distance A of the cable connector 10 at the locking protruding portion 21 in the front-back direction in the attitude is larger than the width (the distance B) of the locking groove portion 57 of the receptacle connector 50 in the same direction as seen in FIG. 3(A).

Therefore, the locking protruding portion 21 cannot enter deep in the locking groove portion 57 with the attitude. Accordingly, the locking protruding portion 21 abuts with at least one of the groove front edge 57A and the groove rear edge 57B of the locking groove portion 57 (the attitude is indicated with the projection line in FIG. 3(B)).

The cable connector 10 may descend keeping the upward attitude without taking horizontal attitude of FIG. 3(A) so as to take the attitude indicated with a solid line in FIG. 3(B) upon moving to the upper position of the receptacle connector 50.

Then, the cable connector 10 is made to be in the upward attitude so as to lift the front end side of the cable connector 10. In the upward attitude, the distance A' between the protrusion front end 21A and protrusion rear end of the locking protruding portion 21 in the front-back direction is smaller than the distance A. The protrusion rear end 21B of the locking protrusion 21 is guided by a tilted guide portion 57B-1 of the groove rear edge 57B and thereby further enters in the locking groove 57, and reaches deep portion of the locking groove 57 (the position and attitude indicated with a solid line in FIG. 3(B)). At this time, the lower end of the inclined portion 21C formed at the protrusion front end 21A of the locking protruding portion 21 is located lower than the lower end of the rising portion 59 in the up-and-down direction as shown with a solid line in FIG. 3(B).

Thereafter, the front end side of the cable connector 10 is descended so as to take the same attitude upon fitting completion of the cable connector 10, i.e., the attitude in FIG. 3(A). The cable connector 10 rotates clockwise around the locking protruding portion 21 side, while the backmost position of the protrusion rear end 21B abutting with an upright portion 57B-2 of the groove rear edge 57B of the locking groove portion 57. Then, the upward attitude is released and thereby the cable connector 10 becomes horizontal and takes the fitting completion attitude (see FIG. 3(C)). Upon the aforementioned rotation, the inclined portion 21C becomes close to the groove front edge 57A while being close to the lower end of the rising portion 59, and comes to a position to interfere with the rising portion 59, i.e. locking position.

On the other hand, when the front end side of the cable 10 rotates to descend, the engaging portion 22 of the cable connector 10 moves over the engaged portion 60 of the receptacle connector 50 and positioned under the engaged portion 60, and becomes locked against the engaged portion 60. In addition, the terminal 61 of the receptacle connector 50 enters between the pair of contact pieces 35 of the terminal 30 of the cable connector 10, and thereby the connectors are electrically connected.

The cable connector 10 that is connected to the receptacle connector 50 after completion of the fitting maintains the horizontal attitude upon fitting completion of the cable connector 10 or takes downward attitude having the front end side downward or merely has attitude where the front end side takes the downward attitude, since the locking protruding portion 21 abuts with the rising portion 59 of the locking groove portion 57 even if the cable connector receives undue backward force after the fitting, even if such force includes undue upward component, and therefore the cable connector 10 would not be pulled out.

In the embodiment, since the engaging portion 22 of the cable connector 10 and the engaged portion 60 of the receptacle connector 50 are locked to each other at the front end side of the connector, even if some force that lifts the front end is applied on the cable connector 10, the front end side would not take the upward attitude and also with the interference between the locking protruding portion 21 and the rising portion 59, the coming off of the cable connector 10 can be securely prevented.

For intentionally pulling out the cable connector 10, relatively large force can be applied upward onto the lifting piece 19 provided on the front end of the cable connector 10. The force releases the locking against the locking force between the engaging portion 19 of the cable connector 10 and the engaged portion 60 of the receptacle connector 50, and causes the upward attitude where the front end side of the cable connector 10 is lifted. The attitude is the same as the attitude indicated with a solid line in FIG. 3(B), and the locking protruding portion 21 can lift outside the locking groove portion 57 without interfering with the rising portion 59, and it is possible to pull out the cable connector 10.

In the embodiment, alternations, variations, or modifications other than those shown in FIGS. 1 through 4(A)-4(C) are possible. For example, in FIGS. 1 through 4(A)-4(C), the tilted guide portion 57B-1, which is an upper portion of the groove rear edge 57B of the locking groove portion 57, ranges alight over the center position in the up-and-down direction of the groove rear edge 57B, and has the upright portion 57B-2 thereunder.

Figure 5A:
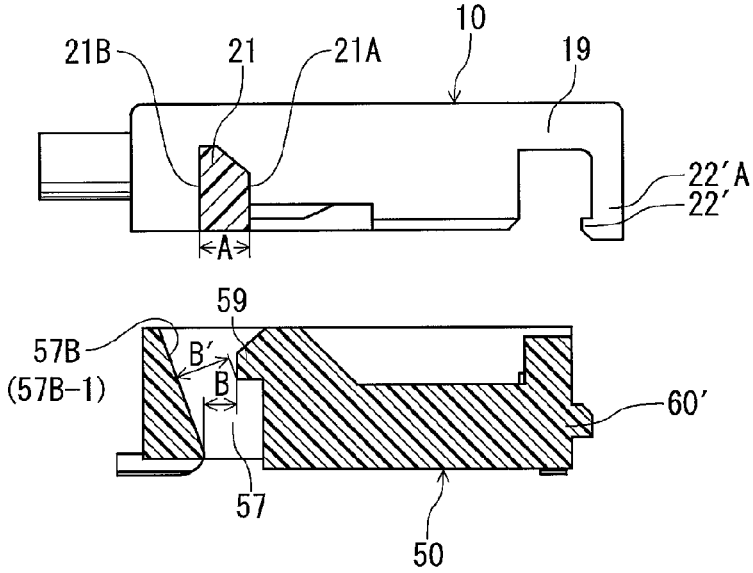
Figure 5B:
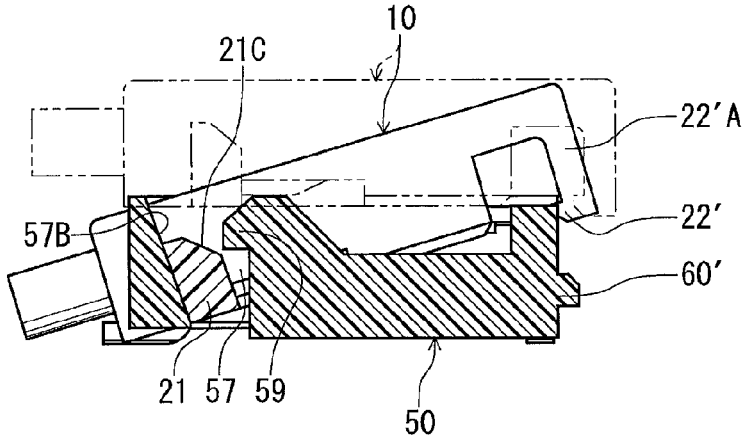
Figure 5C:
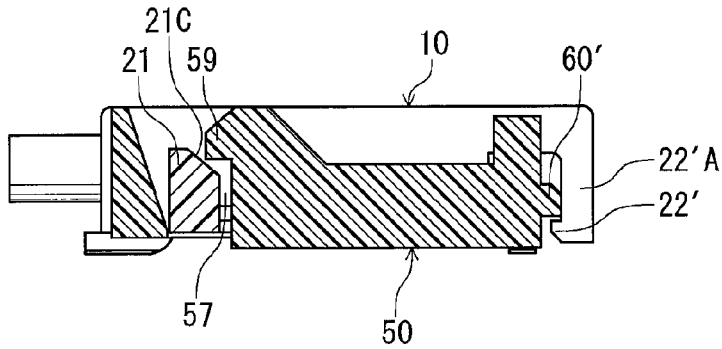

In the embodiment shown in FIGS. 5(A) to 5(C), the tilted guide portion 57B-1 extends almost to the lower end. Accordingly, the locking protruding portion 21 enters the locking groove 57 as if it is sliding therein while being in the tilted state where the protrusion rear end 21B contacts with the tilted guide portion 57B-1 by its face, i.e. while being in the state where the front end of the cable connector 10 directs upward.

At this time, the distance A between the protrusion front end 21A and the protrusion rear end 21B in the front-back direction (cable extending direction) of the locking protruding portion 21, and the minimum distance B' from the tilted guide portion 57B-1 to the rising portion 59, which is measured in the direction orthogonal to the tilted guide portion 57B-1, and the minimum distance B from the tilted guide portion 57B-1 to the protrusion 59, which is measured in the front-back direction, have a relation of the distance B<the distance A<the distance B'.

Accordingly, it is possible to insert the locking protruding portion 21 of the cable connector 10, which is directed upward. After the entering, while abutting the backmost position of the protrusion rear end 21B with the tilted guide portion 57B-1 of the groove rear edge 57B of the locking groove portion 57, the upward attitude is released and thereby even if the cable connector made to the horizontal attitude is lifted at the attitude, the locking protruding portion 21 interferes with the rising portion 59 and the cable connector 10 cannot be come off at the attitude.

Furthermore, in FIGS. 1 through 4, it is also possible to provide on the front end wall the engaging portion 22, which is provided on the side wall surface 20 of the cable connector 10, and the engaged portion 60 provided on the side wall surface 53A of the receptacle connector 50.

In the embodiment shown in FIGS. 5(A) to 5(C), an engaging portion 22' of the cable connector 10 is formed as a claw portion provided on a front end of an arm 22'A that extends downward from the front end of the lifting portion 19. On the other hand, an engaged portion 60' of the receptacle connector 50 is formed on an outer surface of the front end wall as a protruding strip-like portion that extends in the connector width direction (rectangular direction relative to the paper surface in FIGS. 5(A) to 5(C)).

Therefore, in the embodiment shown in FIGS. 5(A) to 5(C), the engaging portion 22' locks with the engaged portion 60' in the fitting completion state of FIG. 5(C) after the before fitting state of FIG. 5(A) and middle of fitting state as in FIG. 5(B). The embodiment of FIGS. 5(A) to 5(C) is the same as the embodiments shown in FIGS. 1 through 4 except the above-described engaging portion 22' and the engaged portion 60'.

In the embodiments of FIGS. 1(A) through 5(C), the locking protruding portion is provided on the cable connector and the locking groove is provided on the receptacle connector. Contrarily, in the embodiment of FIG. 6, the cable connector 10 has the locking groove 57 and the receptacle connector 50 has the locking protruding portion 21.

Figure 6:
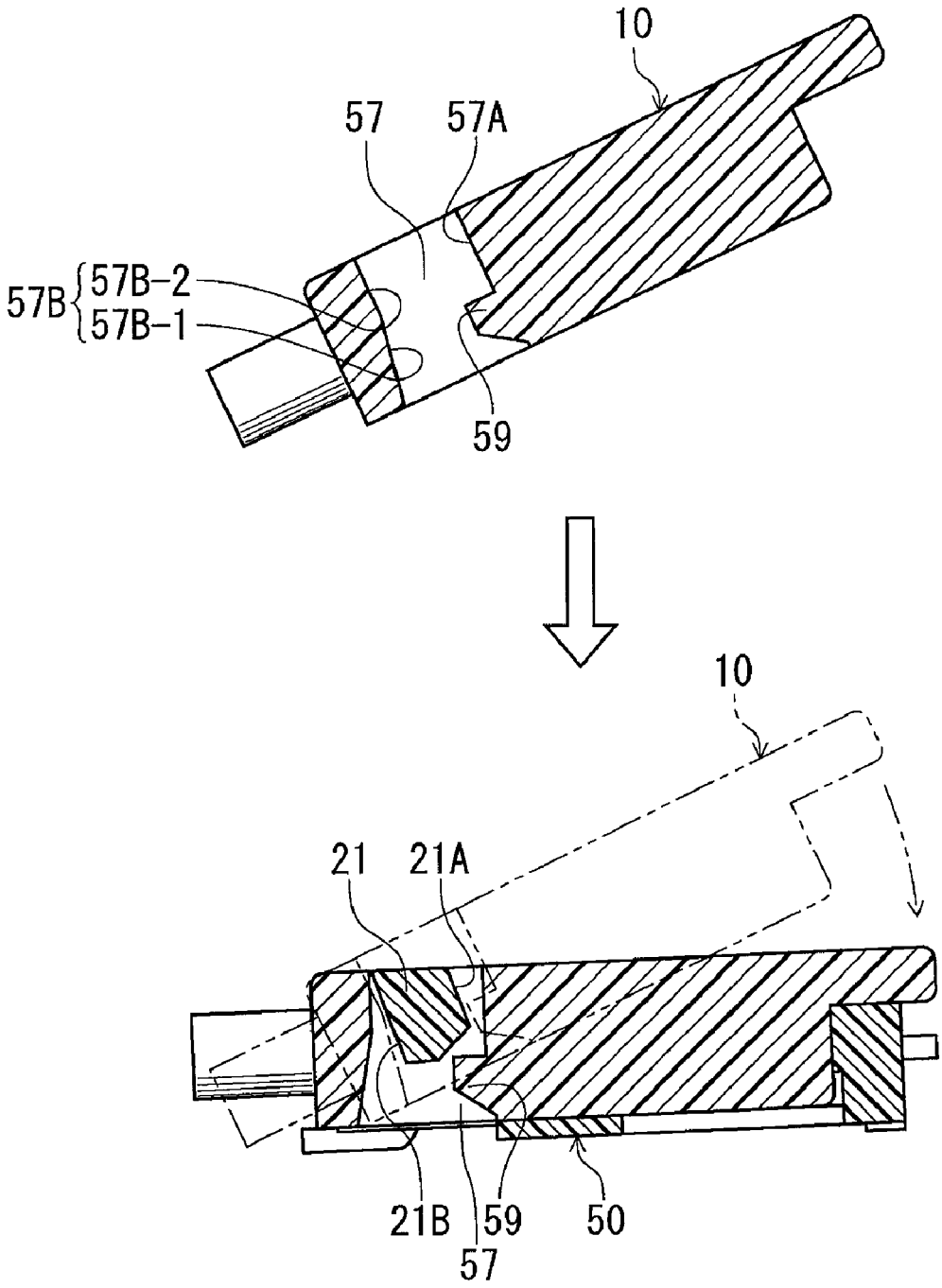
FIG. 6 is a sectional view of yet another embodiment of the invention.

In FIG. 6, the reference numerals in 50s are used for the locking groove portion 57 even for the cable connector 10 and the reference numerals in 20s are used for the locking protruding portion 21 even for the receptacle connector 50 for easy understanding of the correspondence.

The locking groove portion 57 of the cable connector 10 in FIG. 6 has a shape, which is the same as the locking groove portion 57 of the cable connector 10 of FIG. 1 but inversed in the up-and-down direction. Therefore, the positions and the attitudes of the locking protruding portion 21 and the locking groove portion 57 shown in FIG. 6 are the same as the position and the attitude of FIG. 3(C), if seen from the backside of the paper surface of FIG. 6 while inversing in the up-and-down direction. Accordingly, the fitting in FIG. 6(A) is relatively the same as that in FIGS. 3(A) through 3(C) in view of the fitting of the receptacle connector 50 to the cable connector 10 from therebelow, and therefore the physical relationship of respective parts indicated with the same reference numerals are also the same.

Figure 7:
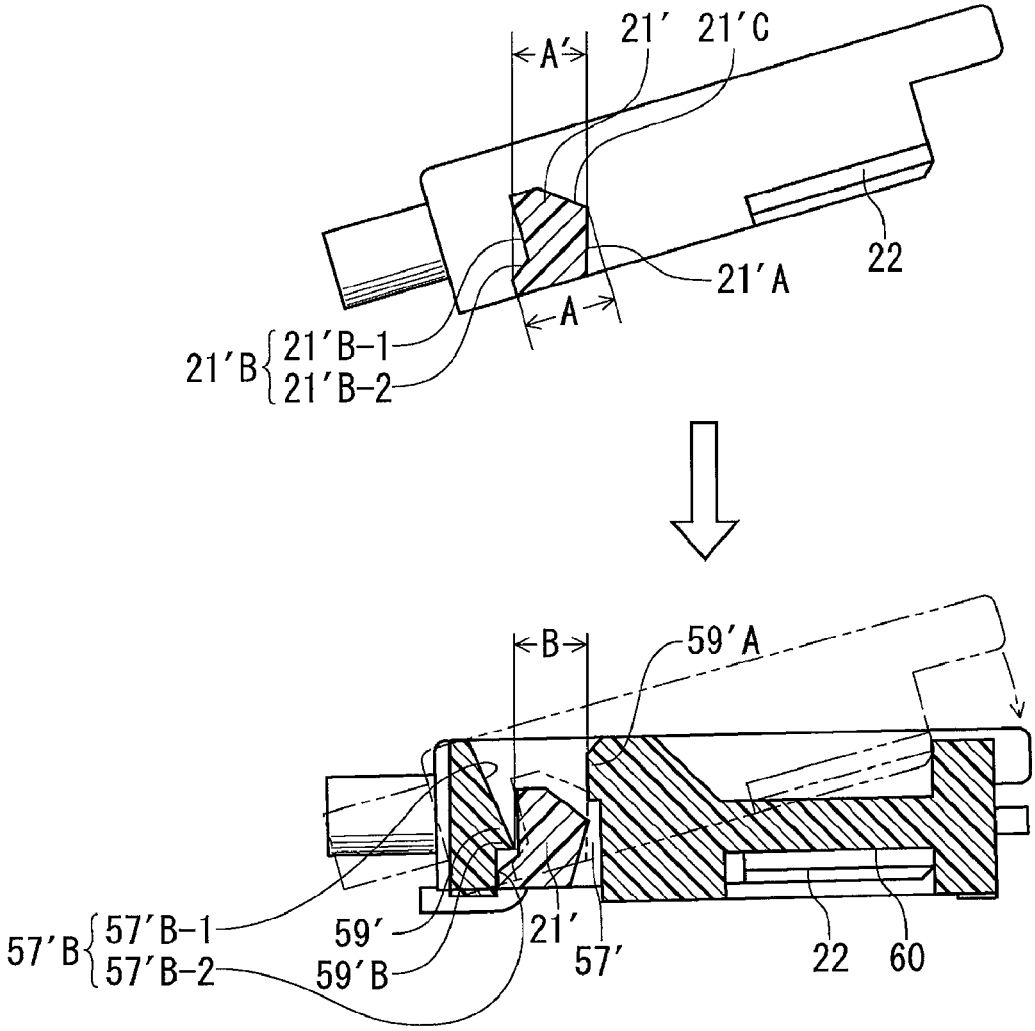
FIG. 7 is a sectional view of still another embodiment of the invention.

Next, the embodiment shown in FIG. 7 is the same as the embodiments of FIGS. 1 through 5 since the cable connector 10 has a locking protruding portion 21' and the receptacle connector 50 has a locking groove portion 57', but are different in a form of a protrusion rear end 21'B of the locking protruding portion 21' and in that a groove rear edge 57'B has a rising portion 59' of the locking groove portion 57'.

The locking protruding portion 21' has a protrusion front end 21'A and an inclined portion 21'C, which are similar to the protrusion front end 21A and the inclined portion 21C in FIG. 3(B), respectively. On the other hand, the protrusion rear end 21'B has an upper upright portion 21'B-1, which extends in a direction orthogonal to the cable extending direction (in the front-back direction at the attitude upon fitting completion), and a lower tilted portion 21'B-2, which extends downward backside at a position therebelow.

On the other hand, the locking groove portion 57' has a front end rising portion 59'A and a rear end rising portion 59'B respectively protruding inside the groove. The front end rising portion 59'A protrudes less than the rising portion 59 in the groove front edge shown in FIGS. 3(A) to 3(C). In addition, there is a step-like portion between the tilted guide portion 57'B-1 and the upright portion 57'B-2 of the groove rear edge 57'B, and the rear end rising portion 59'B is formed at a portion where the tilted guide portion 57'B-1 protrudes more in the groove than the upright portion 57'B. The protrusion of the rear end rising portion, i.e. size of the step-like portion, is greater than the protrusion of the front end protrusion 59'A.

In FIG. 7, the relation between the distance A in the front-back direction at the time when the locking protruding portion 21' is in the horizontal attitude, the distance A' in the front-back direction upon upward tilting, and the distance B, which is the minimum width in the front-back direction of the locking groove portion 57' is distance A'<distance B<distance A, similarly to that of the distance A, distance A', and distance B in FIG. 3(A).

Moreover in FIG. 7, the engaging portion 22' of the cable connector 10 and the engaged portion 60' of the receptacle connector 50 are the same as the engaging portion 22 and the engaged portion 60 shown in FIGS. 3(A) to 3(C).

In the embodiment, the cable connector 10 moves to the position indicated with a projection line by descending from the above of the receptacle connector 50 while the front end indicated with a solid line in FIG. 7 in the upward attitude. Thereafter, the upward attitude of the front end is released to take the horizontal attitude and thereby takes the fitting completion attitude.

In the fitting process, since the distance A' of the locking protruding portion 21' of the cable connector 10 that has the front end in the upward attitude is smaller than the distance B', which is the groove width of the locking groove portion 57' of the receptacle connector 50, the locking protruding portion 21' enters the locking groove portion 57' while being guided by the tilted guide portion 57'B-1 of the locking groove portion 57' taking the upward attitude.

Once the lower tilted portion 21'B-2 of the locking protruding portion 21' reaches the position of the rear end rising portion 59'B of the locking groove portion 57', while the lower tilted portion 21'B-2 slides in relative to the rear end rising portion 59'B downward of the rear end rising portion 59'B, the front end of the cable connector 10 rotates clockwise and thereby the cable connector 10 comes to take the horizontal attitude, and then the fitting attitude.

Upon completion of the fitting, the lower tilted portion 21'B-2 interferes with the rear end rising portion 59'B in the upper direction, and the coming off can be prevented at the time of taking the fitting completion attitude or the attitude where the cable C is lifted and the front end directs downward. In addition, the engaging portion 22' on the front end side is locked to the engaged portion 60', this locking would not be released even if some undue force is applied to lift the front end as long as force to release the locking is intentionally applied, and there by it is possible to prevent the coming off of the connector.

The invention may be further altered, varied, or modified to smoothly operate the fitting process of the cable connector 10 and the receptacle connector 50. The embodiment shown in FIGS. 8(A) to 8(C) is basically the same as the embodiment shown in FIGS. 3(A) to 3(C), but is characterized by a continuous curve provided at a portion where the locking protruding portion and the rising portion of the locking groove portion face so as to smoothly operate the fitting process.

Figure 8A:
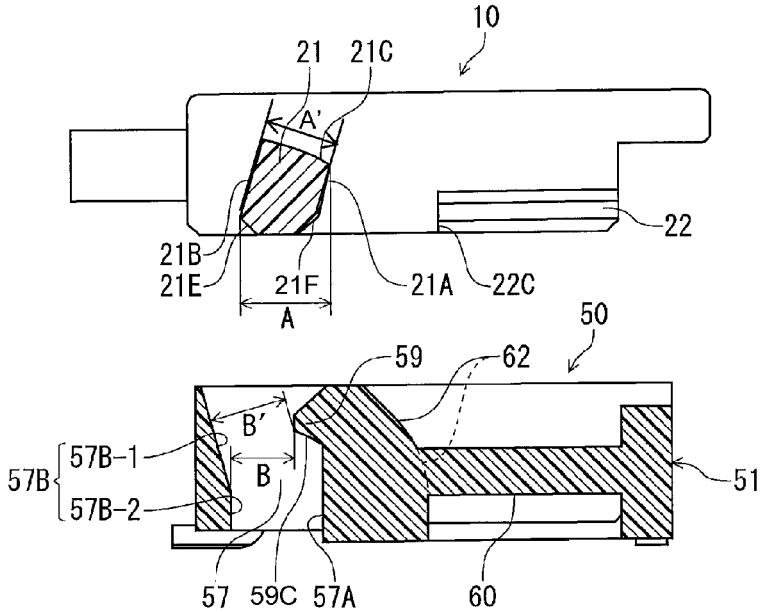
Figure 8B:
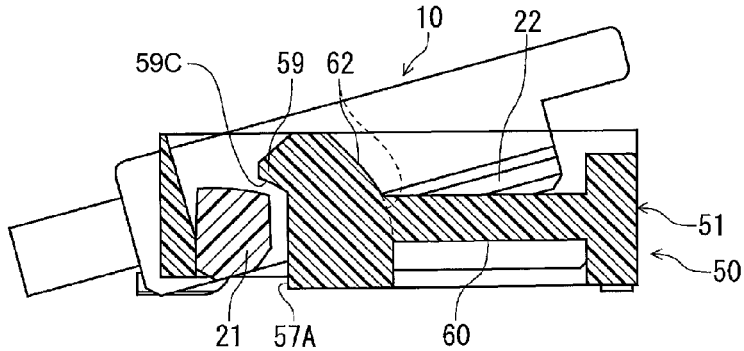
Figure 8C:
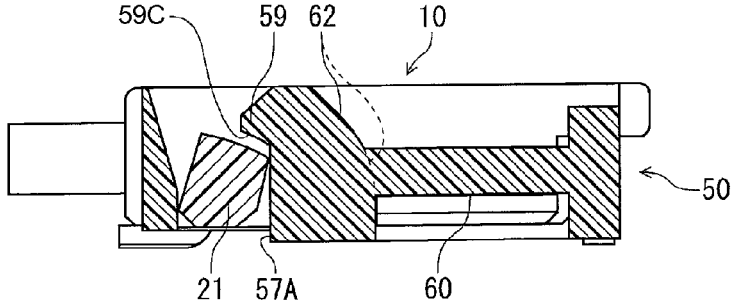

In FIG. 8(A), the locking protruding portion 21 of the cable connector 10 is formed by convex curve that the inclined portion 21C continuously connects the upper end of the protrusion front end 21A and the upper end of the protrusion rear end 21B. In addition, the protrusion front end 21A and the protrusion rear end 21B are tilted in the connector fitting direction, i.e. downward towards the rear end side of the connector in FIGS. 8(A) to 8(C).

At this time, the distance A' between the protrusion front end 21A and the protrusion rear end 21B, the distance A from the protrusion front end 21A to the protrusion rear end 21B, in the front-back direction of the locking protruding portion 21, the minimum distance B' from the tilted guide portion 57B-1 to the protrusion 59, which is measured in the direction orthogonal to the tilted guide portion 57B-1 and the distance B from the groove rear edge 57B to the protrusion 59, which is measured in the front-back direction have relationship of distance B<distance A'<distance B'<distance A, and enables the locking protruding portion 21 of the cable connector 10, which is directed upward to enter, and a front end inclined portion 21F and a rear end inclined portion 21E, which are chamfered on the lower end's front end and rear end respectively are formed.

The front end slanted surface 21F and the rear end inclined portion 21E make introduction of the receptacle connector 50 into the locking groove portion 57 easier. After insertion of the locking protruding portion 21, the backmost position of the protrusion rear end 21B rotates while abutting with the upright portion 57B-2 of the groove rear edge 57B of the locking groove portion, and the upward attitude is released.

On the other hand, the rising portion 59 formed on the locking groove portion 57 of the receptacle connector 50 has a lower end 59C that is formed to have a concave curve that fits to the inclined portion 21C of the cable connector 10. Accordingly, if the cable connector 10 is pulled upward after fitting to the receptacle connector 50 in the regular state, the inclined portion 21C of the locking protruding portion 21 and the lower end 59C of the rising portion 59 abut at their surfaces, and thereby they are hardly damaged because of their reduced load and the positions are not displaced and are stabilized.

In the embodiment, the above-described convex curve and concave curve may be replaced with one straight line that approximates them.

Furthermore, in the embodiment, when the engaging portion 22 of the cable connector 10, which locks to the engaged portion 60 provided on the receptacle connector 50, rotates towards the engaged portion 60, a guide portion 62 is provided on the receptacle connector 50 to guide the lower end's rear end 22C of the engaging portion 22. The guide portion 62 is formed to have a surface that forms a convex curve from the upper end to the lower end of the housing 51 of the receptacle connector 50, extending in a height direction.

In the embodiment shown in FIGS. 8(A) to 8(C) as described above, the cable connector 10 descends from a position shown in FIG. 8(A) and the locking protruding portion 21 is introduced in the locking groove portion 57 at the front end inclined portion 21F and the rear end inclined portion 21E. Then, as shown in FIG. 8(B), the lower end's rear end of the engaging portion 22 is guided by the guide portion 62 and thereby rotates from the slanted state to the horizontal state, so that the engaging portion 22 locks with the engaged portion 60 so as to be in the locked state as shown in FIG. 8(C).

At this time, since the locking protruding portion 21 is slanted downward towards the rear end side of the connector, the forefront position of the protrusion front end 21A becomes very close to the upright front end of the groove front end 57A of the locking groove portion 57.

Accordingly, the locking protruding portion 21 interferes even more with the rising portion 59, and thereby it is possible to securely prevent the cable connector 10 from coming off. In addition, since the backmost position of the protrusion rear end 21B abuts with the upright portion 57B-2 of the groove rear edge 57B and the backmost position of the protrusion front end 21A is very close to the upright front end of the groove front end 57A of the locking groove portion 57, the displacement in the front-back direction can be also eliminated.

It should be understood that the invention shall not be limited by those embodiments shown in the accompanying drawings and may be altered, varied, and modified. For example, the locking protruding portion may be divided into a plurality of protrusions in the connector fitting direction. In this case, the plurality of the locking protruding portion is designed to have physical relationship, whereby the protrusion front ends and protrusion rear ends are respectively generally connected.

Moreover, the locking groove portion may be formed through in a wall thickness direction of the side wall instead of forming as a recess portion on one surface side of the side wall as in the illustrated embodiments.

The disclosure of Japanese Patent Applications No. 2009-099978, filed on Apr. 16, 2009 and No. 2010-011225, filed on Jan. 21, 2010 are incorporated in the application by reference.

While the invention has been explained with reference to the specific embodiments of the invention, the explanation is illustrative and the invention is limited only by the appended claims.

What is claimed is:

1. An electrical connector assembly for connecting a cable, comprising:

a cable connector having a first terminal to be connected to the cable;

a receptacle connector having a second terminal for electrically contacting with the first terminal, said receptacle connector further having a recessed portion for accommodating a substantially entire portion of the cable connector so that the receptacle connector is connected to the cable connector in a first direction;

a locking protruding portion disposed on one of the cable connector and the receptacle connector, said locking protruding portion having a first length in a second direction perpendicular to the first direction; and a locking groove portion disposed in the other of the cable connector and the receptacle connector, said locking groove portion having a second distance in the second direction smaller than the first length so that the locking protruding portion can be inserted into the locking groove portion only in an inclined state.

2. The electrical connector assembly according to claim 1, wherein said locking protruding portion is disposed on the cable connector, and said locking groove portion is disposed in the receptacle connector.

3. The electrical connector assembly according to claim 1, wherein said locking protruding portion is disposed on the receptacle connector, and said locking groove portion is disposed in the cable connector.

4. The electrical connector assembly according to claim 1, wherein said locking protruding portion includes a protruding portion front edge and a protruding portion rear edge, at least one of said protruding portion front edge and said protruding portion rear edge being inclined relative to the first direction.

5. The electrical connector assembly according to claim 1, wherein said locking protruding portion includes a protruding portion front edge and a protruding portion rear edge, said protruding portion front edge extending in parallel to the protruding portion rear edge.

6. The electrical connector assembly according to claim 1, wherein said locking groove portion includes a rising portion, said locking protruding portion including an inclined portion facing the rising portion.

7. The electrical connector assembly according to claim 6, wherein said rising portion includes a straight portion or a curved portion, said inclined portion including a corresponding straight portion or a corresponding curved portion.

8. The electrical connector assembly according to claim 1, further comprising an engaging portion disposed on the cable connector and an engaged portion disposed on the receptacle connector for engaging the engaging portion.

9. The electrical connector assembly according to claim 1, wherein said receptacle connector includes a cut portion for accommodating a part of the cable connector when the cable connector is inclined relative to the receptacle connector.

10. The electrical connector assembly according to claim 1, wherein, said first terminal includes a pair of contact pieces for receiving the second terminal in between.

11. The electrical connector assembly according to claim 1, wherein said recessed portion has a depth substantially equal to a height of the cable connector in the first direction so that the cable connector is flush with the receptacle connector when the cable connector is accommodated in the recess portion.

12. The electrical connector assembly according to claim 1, wherein said recessed portion has a substantially rectangular shape corresponding to an outer shape of the cable connector.

* * * * *